US010038309B2

(12) United States Patent
Bundschuh

(10) Patent No.: US 10,038,309 B2
(45) Date of Patent: Jul. 31, 2018

(54) CERAMIC SPARK PLUG INSULATOR, SPARK PLUG, AND USE OF A GLAZE ON A SPARK PLUG INSULATOR

(71) Applicant: Robert Bosch GmbH, Stuttgart (DE)

(72) Inventor: Klaus Bundschuh, Bamberg (DE)

(73) Assignee: Robert Bosch GMBH, Stuttgart (DE)

( * ) Notice: Subject to any disclaimer, the term of this patent is extended or adjusted under 35 U.S.C. 154(b) by 0 days.

(21) Appl. No.: 15/508,177

(22) PCT Filed: Jul. 22, 2015

(86) PCT No.: PCT/EP2015/066741
§ 371 (c)(1),
(2) Date: Mar. 2, 2017

(87) PCT Pub. No.: WO2016/037751
PCT Pub. Date: Mar. 17, 2016

(65) Prior Publication Data

US 2017/0256918 A1 Sep. 7, 2017

(30) Foreign Application Priority Data

Sep. 10, 2014 (DE) ..... 10 2014 218 062

(51) Int. Cl.
*H01T 13/38* (2006.01)
*H01T 13/08* (2006.01)
*H01T 13/32* (2006.01)

(52) U.S. Cl.
CPC ..... *H01T 13/38* (2013.01); *H01T 13/08* (2013.01); *H01T 13/32* (2013.01)

(58) Field of Classification Search
CPC ..... H01T 13/38
USPC ..... 313/142
See application file for complete search history.

(56) References Cited

U.S. PATENT DOCUMENTS 1,355,272 A * 10/1920 Sauereisen ..... H01T 13/38 313/118
5,859,491 A * 1/1999 Nishikawa ..... H01T 13/38 313/118
5,985,473 A 11/1999 Knapp
6,492,289 B1 * 12/2002 Suzuki ..... C03C 8/02 313/118
6,590,318 B2 * 7/2003 Nishikawa ..... C03C 8/02 313/143
7,710,006 B2 * 5/2010 Kyuno ..... H01T 13/20 123/169 E
7,906,893 B2 * 3/2011 Moribe ..... H01T 13/38 313/118

(Continued)

FOREIGN PATENT DOCUMENTS

CN 1917315 A 2/2007
CN 101277000 A 10/2008
EP 0788204 A1 8/1997

(Continued)

OTHER PUBLICATIONS

International Search Report dated Sep. 21, 2015, of the corresponding International Application PCT/EP2015/066741 filed Jul. 22, 2015.

*Primary Examiner* — Christopher Raabe
(74) *Attorney, Agent, or Firm* — Norton Rose Fulbright US LLP; Gerard Messina

(57) ABSTRACT

A ceramic spark plug insulator with improved electrical and mechanical strength.

14 Claims, 3 Drawing Sheets

(56) References Cited

U.S. PATENT DOCUMENTS

2004/0066126 A1* 4/2004 Geier ..... H01T 13/38
313/143

FOREIGN PATENT DOCUMENTS

| | | | |
|---|---|---|---|
| EP | 1130728 | A2 | 9/2001 |
| EP | 1193816 | A2 | 4/2002 |
| JP | S59130079 | A | 7/1984 |
| JP | H02253587 | A | 10/1990 |
| JP | 2001244043 | A | 9/2001 |

* cited by examiner

CERAMIC SPARK PLUG INSULATOR, SPARK PLUG, AND USE OF A GLAZE ON A SPARK PLUG INSULATOR

FIELD

The present invention relates to a ceramic spark plug insulator, to a spark plug including the same, and to a use of a glaze on a spark plug insulator.

BACKGROUND INFORMATION

In order to save installation space in the cylinder head of a motor vehicle, there is a trend toward long, slender spark plugs. For this purpose, the wall thicknesses of the ceramic insulator, in particular in the root area of the spark plugs determining the geometry of the center electrodes, are also decreased. This frequently results in problems with the electrical strength, particularly in combustion chamber-side areas in which additionally the cross section of the insulator is reduced, since very high field strengths are present here. The service life of such spark plugs having a reduced installation space is thus low.

SUMMARY

The ceramic spark plug insulator according to the present invention has a high dielectric strength, while having a more slender geometry. This is achieved by the application of a glaze to a root fillet which is formed in the insulator and which represents a transition area between an insulator area situated in the combustion chamber and an insulator area situated outside the combustion chamber. The root fillet is a section of the spark plug insulator, in which the cross section tapers or decreases in the direction of the insulator root tip. The root fillet reflects the decrease in the dimensioning of an installation space-reduced spark plug. Only by the application of a glaze onto an entire first surface area A of the root fillet which is directed toward the outer side of the spark plug insulator does it become possible to provide a spark plug insulator having more slender dimensions, and thus also an installation space-saving spark plug, which have no losses in the stability in an electrical and a mechanical respect. Due to the application of the glaze, the roughness of the first surface area A of the spark plug insulator, which has a first length $L_A$ in axial direction X-X of the spark plug insulator, is reduced, and open pores and recesses, as they arise, for example, during the grinding process of the insulator, are closed. Length $L_A$ is defined as the maximum length in axial direction X-X of the spark plug insulator. As a result, local excessive increases in the electrical field during operation of the spark plug are minimized. As a result, the dielectric breakdown does not take place until higher voltages are applied. The dielectric strength of a spark plug including the ceramic insulator according to the present invention is thus improved. Moreover, the surface of the insulator may be smoothed, and thus the formation of notches in the root fillet may be reduced, with the aid of the glaze, which optimizes the mechanical lateral load capacity in this area and increases the strength of the spark plug under operating conditions. The glaze forms a kind of protective layer for this purpose, which increases the strength of the spark plug insulator in areas subject to high mechanical loads, such as the root fillet. In this way, in particular a cross section of the spark plug insulator in the area of the root fillet and in insulator areas adjoining the root fillet may also be reduced. Moreover, by applying the glaze, a mechanical compressive stress may be built up after melting the glaze, on the surface of the insulator, which results in a partial pre-compensation of a tensile stress when bending loads act on the insulator surface. This also improves the mechanical stability of the spark plug insulator.

Preferred refinements of the present invention are described herein.

In order to improve the dielectric strength and the mechanical stability of the ceramic spark plug insulator, the spark plug insulator includes an adjacent second surface area B, which is situated with respect to the root fillet in the direction of the insulator head and has a second length $L_B$ defined in axial direction X-X of the spark plug insulator, and an adjacent third surface area C, which is situated on the combustion chamber side with respect to the root fillet and has a third length $L_C$ defined in axial direction X-X of the spark plug insulator. At least one of the following relationships is thus met: $L_A=L_B$ and/or $L_A=L_C/2$ and/or $L_B=L_C/2$. The lengths of the corresponding surface areas are each defined as the maximum lengths in axial direction X-X of the spark plug insulator.

In order to particularly effectively avoid notching in the area of progression surrounding the root fillet, and thereby further improve the mechanical lateral load capacity of the spark plug insulator, it is furthermore advantageously provided that second surface area B includes a glazed fourth surface area D situated adjacent to the root fillet, and a unglazed fifth surface area E adjoining fourth surface area D in the direction of the insulator head. Fourth surface area D extends from the root fillet up to 4 mm, and in particular up to 3 mm, in the direction of the insulator head of the spark plug insulator.

In order to spatially segregate the area of the high electrical fields from the area of the highest mechanical load, it is furthermore advantageously provided that adjacent third surface area C situated on the combustion chamber side from the root fillet includes a glazed sixth surface area F which is situated adjacent to the root fillet and has a sixth length $L_F$, and a unglazed seventh surface area G which adjoins sixth surface area F in the direction of an insulator root tip and has a seventh length $L_G$, each of the lengths being defined as maximum lengths in axial direction X-X of the spark plug insulator, with the following relationship being met: $L_F \geq L_G$.

For the above-described reasons, the glazed sixth surface area F moreover advantageously extends from the root fillet on the combustion chamber side maximally up to 2 mm in front of the combustion chamber-side insulator root tip. As an alternative or in addition, sixth length $L_F$ of sixth surface area F meets the following relationship: $4\ \text{mm} \leq L_F \leq (L_A+L_E+L_F)/2$, the lengths in each case being defined as maximum lengths in axial direction X-X of the spark plug insulator. Moreover, shunts (creeping sparks) on the root fillet may thus be better avoided.

For an even more slender design of the spark plug insulator without having to tolerate losses in the mechanical and electrical load capacity, the insulator head and the insulator root are connected by an installation area. The installation area adjoins the root fillet on the insulator head side and thus includes second surface area B. The installation area includes a collar fillet and a collar height adjoining the collar fillet in the direction of the insulator head. A collar fillet shall be understood to mean an area of the spark plug insulator which decreases in the cross section in the direction of the insulator root. A collar height is the area of the spark plug insulator which mostly includes a hexagon which facilitates the installability of the spark plug in an engine block. The collar height thus represents a section having a widened cross section compared to the remaining, surrounding sections of the spark plug insulator. In order to increase the mechanical stability, an eighth surface area H of the collar fillet which is directed toward the outer side of the spark plug insulator also includes a glaze.

In order to further increase the flexural strength of the spark plug insulator, not only is a glaze included on a surface area of the collar fillet which is directed toward the outer side of the spark plug insulator, i.e., eighth surface area H, having an eighth length $L_H$, but also on a ninth surface area I of the collar height which adjoins the collar fillet and is thus adjacent to the collar fillet in the direction of the insulator head. Ninth surface area I of the collar height is thus glazed on a ninth length $L_I$. Ninth surface area I is adjoined in the direction of the insulator head by a tenth surface area J having a tenth length $L_J$. Tenth surface area J does not include a glaze provided according to the present invention, and the following relationship is met:

$$0<L_I\leq(L_J+L_I)/2$$

A particularly spark-stable and mechanically load-carrying glaze is characterized by the following composition:

$SiO_2$: 37.0 to 46.0 wt. %, preferably 37.0 to 44.0 wt. %
$B_2O_3$: 12.0 to 28.0 wt. %, preferably 17.5 to 23.0 wt. %
$Al_2O_3$: 4.0 to 21.0 wt. %, preferably 8.5 to 16.0 wt. %
ZnO: 6.0 to 11.4 wt. %, preferably 7.8 to 11.4 wt. %
F: 0.6 to 4 wt. %, preferably 0.6 to 3.0 wt. %
$Li_2O$: 1.5 to 4 wt. %, preferably 1.9 to 3.5 wt. %
$Na_2O$: 0.1 to 2.5 wt. %, preferably 0.1 to 2.0 wt. %
$K_2O$: 0.5 to 4.5 wt. %, preferably 3.0 to 4.5 wt. %
CaO: 1.8 to 6 wt. %, preferably 2.1 to 4.2 wt. %
SrO: 0.1 to 3.6 wt. %, preferably 0.1 to 1.2 wt. % and
BaO: 0.8 to 6.8 wt. %, preferably 4.5 to 6.5 wt. %, the indicated values in each case referring to the total weight of the glaze.

In order to prevent surface defects in the glaze when the protective glaze is at its maximum, a layer thickness of the glaze is 5 μm to 40 μm, and in particular 7 μm to 25 μm, on average.

Also according to the present invention, a spark plug for an internal combustion engine is described, which includes a metallic housing, a center electrode, at least one ground electrode situated on the housing, and a ceramic spark plug insulator as described above, in order to separate the center electrode from the ground electrode. The spark plug according to the present invention, having an installation space-saving design, is characterized by a high dielectric strength and good mechanical load capacity due to the glaze which is partially applied and directed at the outer side of the spark plug insulator. The electrical strength and the mechanical strength of the spark plug, and thus also its service life, are high.

Advantageously, the glaze is also designed in such a way that an inner seal, in general a sealing ring, for the gas-tight sealing of the combustion chamber between the ground electrode and the center electrode may be dispensed with.

In order to simplify the application of the glaze and thus increase the cycle time for the spark plug insulator production, the glaze may also cover all surface areas of the spark plug insulator.

Furthermore, according to the present invention also use of a glaze on areas of a spark plug insulator having a decreasing cross section, in particular in an area of a root fillet, a transition area between the insulator area situated in the combustion chamber and the insulator area situated outside the combustion chamber, in order to increase the dielectric strength of a spark plug, is described.

Exemplary embodiments of the present invention are described hereafter in greater detail with reference to the figures. Identical reference numerals denote identical components.

DETAILED DESCRIPTION OF EXAMPLE EMBODIMENTS

Figure 1:
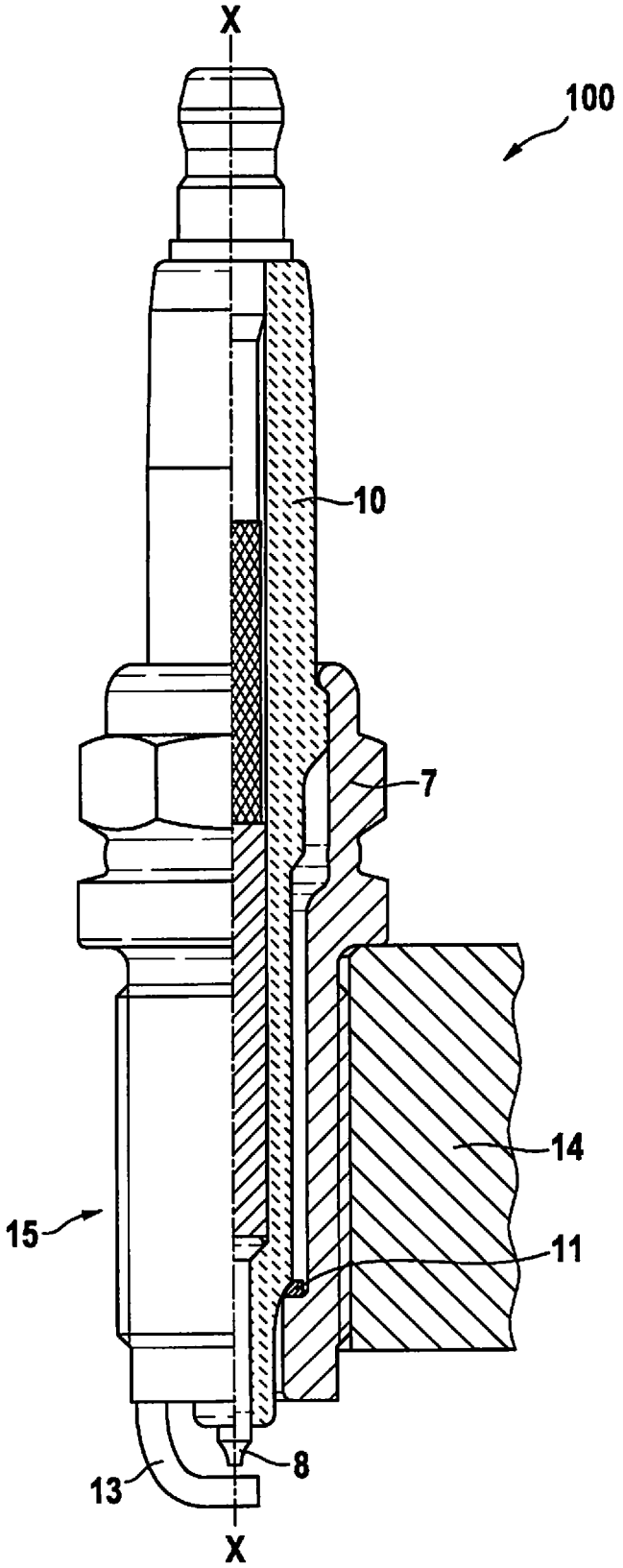
FIG. 1 shows a partial sectional view of a first spark plug according to the present invention.

As shown in FIG. 1, spark plug 100 according to the present invention includes a ground electrode 13, a center electrode 8, and a ceramic spark plug insulator 10. A metallic housing 7 surrounds spark plug insulator 10 at least partially. A thread 15, which is designed for attaching spark plug 100 in a cylinder head 14, is situated on housing 7. A sealing ring 11 seals the combustion chamber of spark plug 100 in a gas-tight manner.

Figure 2:
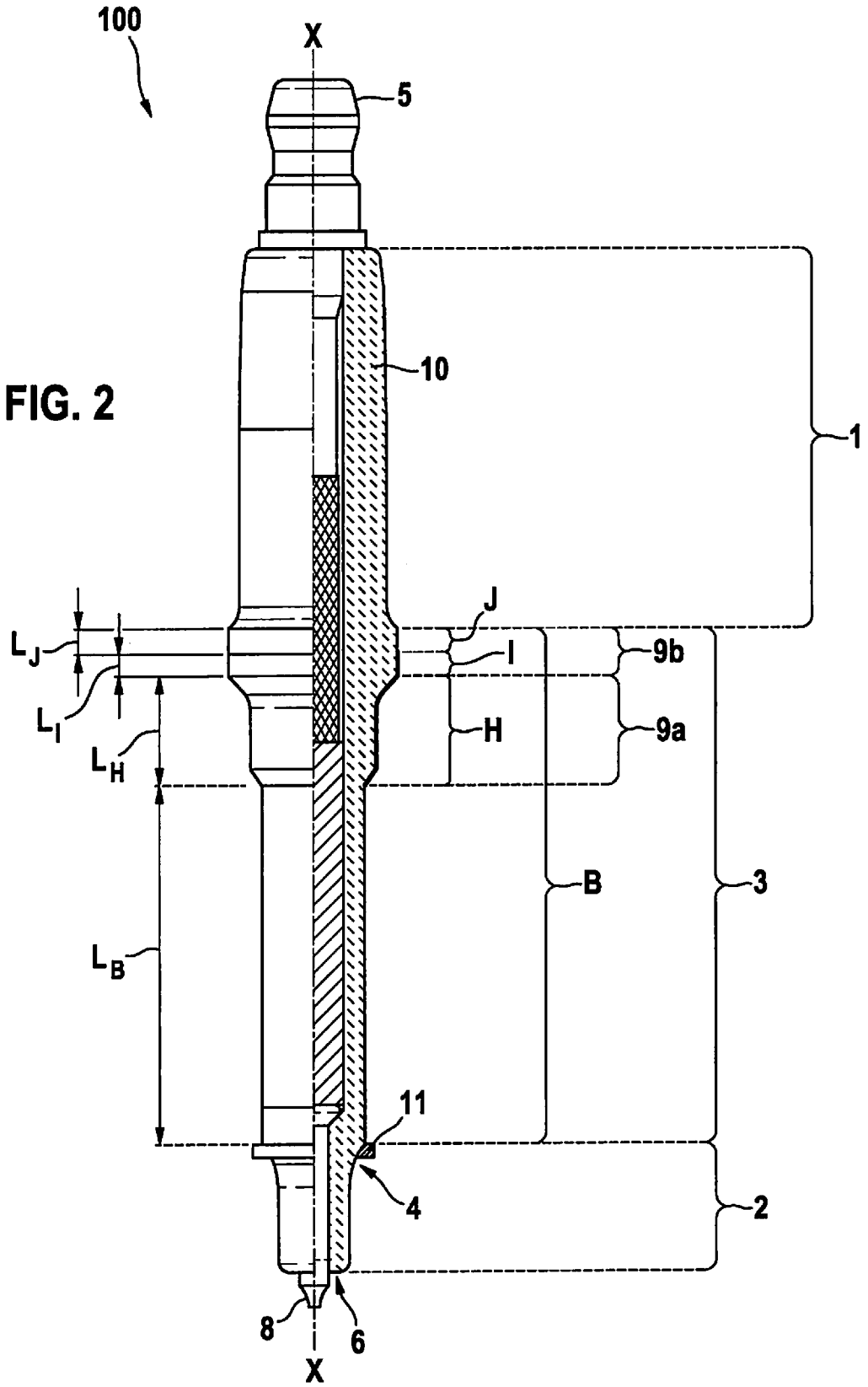
FIG. 2 shows a partial sectional view of the spark plug of FIG. 1.

FIG. 2 shows a partial sectional view of spark plug 100 of FIG. 1 and illustrates in particular the area of spark plug insulator 10. Spark plug insulator 10 includes an insulator head 1 oriented in the direction of an electrical connection area 5 and a combustion chamber-side insulator root 2. An installation area 3, which includes a cross-sectional reduction, a so-called collar fillet 9*a* and a collar height 9*b*, is situated between insulator head 1 and insulator root 2.

There is also an area in insulator root 2 in which the cross section is reduced, a so-called root fillet 4, i.e., a transition area between insulator root 2 situated in the combustion chamber and the insulator area situated outside the combustion chamber. The combustion chamber, as shown here, may be sealed off from the area outside the combustion chamber in a gas-tight manner by a sealing ring 11.

Root fillet 4 has a first surface area A, which is directed toward the outer side of spark plug insulator 10 and has a first length $L_A$ defined in axial direction X-X of the spark plug insulator, and includes a glaze 12 and is thus glazed. On an adjacent section of spark plug insulator 10, i.e., installation area 3, situated with respect to root fillet 4 in the direction of insulator head 1, spark plug insulator 10 has a second surface area B directed toward the outer side of spark plug insulator 10. In an adjacent section of spark plug insulator 10 which is situated from root fillet 4 on the combustion chamber side, insulator root 2 has a third surface area C directed toward the outer side of spark plug insulator 10. Surface area C is unglazed.

On an eighth surface area H which is directed toward the outer side of spark plug insulator 10 and has an eighth length $L_H$, collar fillet 9*a* includes a glaze 12.

Collar height 9*b* includes a surface area I having a ninth length $L_I$, and a unglazed tenth surface area J which adjoins ninth surface area I in the direction of insulator head 1 and has a tenth length $L_J$, ninth surface area I including a glaze 12, with the following relationship being advantageously met:

$$0<L_I=(L_J+L_I)/2.$$

Figure 3:
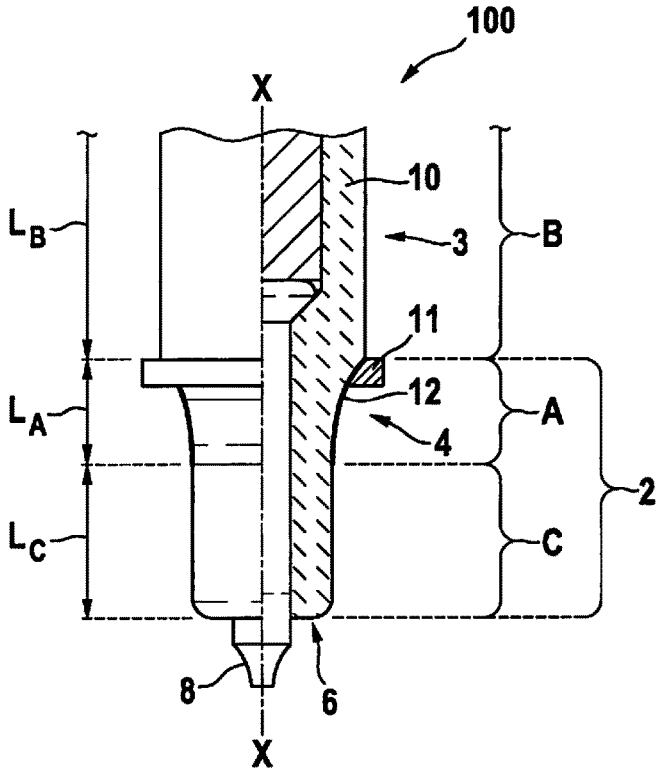
FIG. 3 shows an enlarged detail of the partial sectional view of the spark plug of FIG. 2.

FIG. 3 shows a close-up view of a detail of the transition area between insulator root 2 situated in the combustion chamber and the area of spark plug insulator 10 of spark plug 100 which is situated outside the combustion chamber of FIGS. 1 and 2. Here, the surface area of root fillet 4 coincides with first surface area A, i.e., a glaze 12 is provided exclusively in an area of root fillet 4 having a reduced cross section, and here in its entire first surface area A. The cross section in the adjacent unglazed areas of root fillet 4 is essentially constant.

Glaze 12 advantageously has an average layer thickness of 5 μm to 40 μm, in particular of 7 μm to 25 μm.

Glaze 12 significantly increases the flexural strength of the ceramic insulator. For spark plug 100 according to the present invention, it is more than 850 N, while corresponding unglazed spark plugs have flexural strengths of only approximately 660 N.

The dielectric strengths of spark plug 100 according to the present invention are also considerably increased and are at least approximately 42 kV, while comparable conventional spark plugs have dielectric strengths of only approximately 35 kV.

First surface area A has a first length $L_A$, second surface area B has a second length $L_B$, and third surface area C has a third length $L_C$. The respective lengths are maximum lengths and defined in axial direction X-X of the spark plug insulator. A total length of insulator root 2 in axial direction X-X of spark plug insulator 10 thus results from: $L_A+L_C$.

Advantageously, at least one of the following relationships exists between the lengths of the individual surface areas: $L_A=L_B$ and/or $L_A=L_C/2$ and/or $L_B=L_C/2$.

Figure 4:
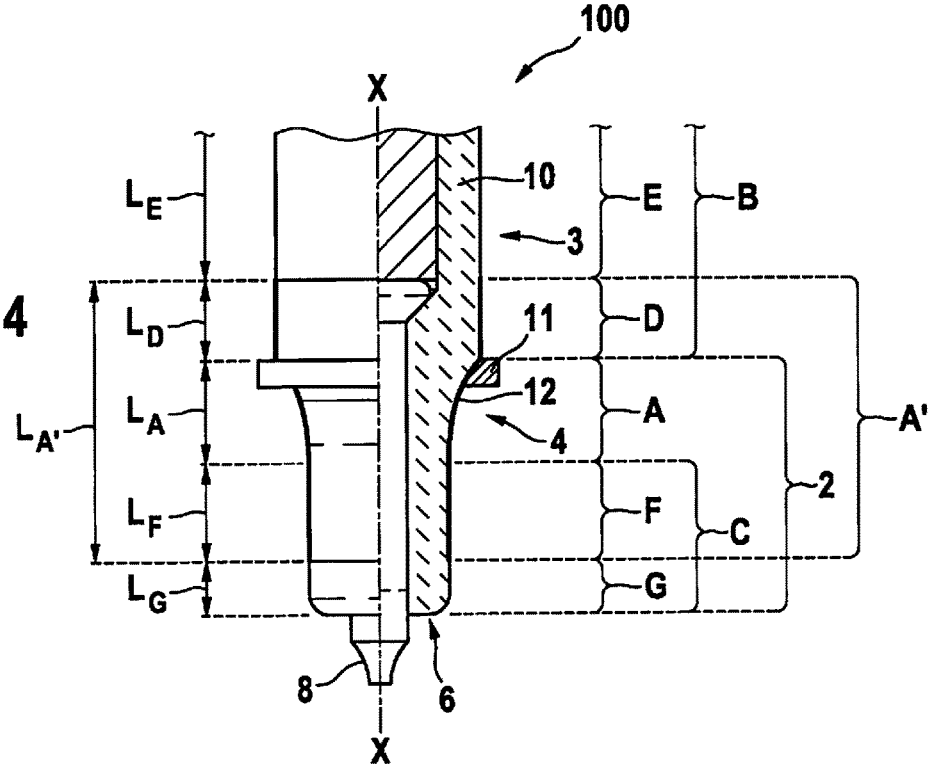
FIG. 4 shows an enlarged detail of a partial sectional view of a second spark plug according to the present invention.

FIG. 4 shows a close-up view of a detail of the transition area between insulator root 2 situated in the combustion chamber and the area of spark plug insulator 10 of a second spark plug 100 according to the present invention which is situated outside the combustion chamber.

In contrast to spark plug 100 of FIGS. 1 through 3, second surface area B includes a fourth surface area D situated adjacent to root fillet 4, and a fifth surface area E adjoining fourth surface area D in the direction of insulator head 1. As well as first surface area A, fourth surface area D includes a glaze 12. Proceeding from root fillet 4, the glazed surface area is thus expanded in the direction of insulator head 1, and in particular glazed fourth surface area D extends from root fillet 4 up to 4 mm, in particular up to 3 mm, in the direction of insulator head 1.

Furthermore, third surface area C includes a glazed sixth surface area F situated adjacent to root fillet 4, and an unglazed seventh surface area G adjoining sixth surface area F in the direction of insulator root tip 6, so that the glaze, proceeding from root fillet 4, also extends in the direction of insulator root tip 6 situated on the combustion chamber side.

Glazed sixth surface area F extends from root fillet 4 on the combustion chamber side maximally up to 2 mm in front of insulator root tip 6 on the combustion chamber side, which prevents notch formation due to mechanical load.

Advantageously, glazed sixth surface area F has a sixth length $L_F$, and the following relationship is met: $4\text{ mm} \leq L_F \leq (L_A+L_F+L_G)/2$, the lengths in each case being defined as maximum lengths in axial direction X-X of the spark plug insulator.

In FIG. 4, surface area A' represents a glaze-covered total surface area. Glazed total surface area A' includes the surface area of root fillet A and extends in the direction of insulator head 1 beyond first surface area of root fillet 4 onto fourth surface area D, and onto sixth surface area F on the combustion chamber side. This contributes to the lateral load capacity of spark plug insulator 10.

In summary, first surface area A thus has a first length $L_A$, second surface area B has a second length $L_B$, third surface area C has a third length $L_C$, and fourth surface area D has a fourth length $L_D$, fifth surface area E has a fifth length $L_F$, sixth surface area F has a sixth length $L_F$, and seventh surface area G has a seventh length $L_G$. Glazed total surface area A' thus has a total length of: $L_{A'}=L_A+L_D+L_F$. The total length of insulator root 2 furthermore results from: $L_A+L_F+L_G$. The respective lengths are maximum lengths and defined in axial direction X-X of spark plug insulator 10.

Advantageously, sixth glazed surface area F has a length $L_F$, and unglazed seventh surface area G directed toward insulator root tip 6 has a length $L_G$, and the following relationship is met: $L_F\ L_G$.

With an installation space-saving design, spark plugs 100 are characterized by a high dielectric strength and very good mechanical load capacity.

What is claimed is:

1. A ceramic spark plug insulator, comprising:

an insulator head oriented in a direction of an electrical connection area;

a combustion chamber-side insulator root that includes a root fillet;

wherein:

with respect to a direction of axial extension of the spark plug, an exterior diameter of the insulator in a region of the root fillet gradually decreases between first and second axial ends of the root fillet, from a first diameter at the first axial end of the root fillet to a second diameter at the second axial end of the root fillet;

the exterior diameter remains constant at the second diameter within a first constant-diameter axial region of the insulator root that extends from the second axial end of the root fillet in a direction away from the insulator head towards a tip of the insulator root;

the exterior diameter remains constant at the first diameter within a second constant-diameter axial region of the insulator that extends from the first axial end of the root fillet in a direction away from the tip of the insulator root;

a first exterior surface area of the insulator, which axially spans an entirety of an axial span of the root fillet, is glazed with a glaze; and the axial span of the insulator root is of a first length $L_A$.

2. The ceramic spark plug insulator as recited in claim 1, wherein:

a second exterior surface area of the insulator extends over the second constant-diameter axial region, whose axial span is of a second length $L_B$ and which extends from the first axial end of the root fillet until an opposite axial end of the second constant-diameter axial region at which the exterior diameter of the insulator begins to change in an axial direction away from the tip of the insulator root;

the insulator terminates at the tip of the insulator root;

a third exterior surface area of the insulator that axially spans from the second axial end of the root fillet until the tip of the insulator root and is of a third length $L_C$; and at least one of the following:

$L_A=L_B$;

$L_A=L_C/2$; and $L_B=L_C/2$.

3. The ceramic spark plug insulator as recited in claim 2, wherein a first sub-region of the second exterior surface area, which is axially immediately adjacent to the root fillet, is glazed with the glaze, and a second sub-region of the second exterior surface area, which is axially distal from the root fillet and immediately adjacent the first sub-region, is unglazed, an axial length of the first sub-region being ≤4 mm.

4. The ceramic spark plug insulation as recited in claim 3, wherein the axial length of the first sub-region is ≤3 mm.

5. The ceramic spark plug insulator as recited in claim 3, wherein:

a first sub-region of the third exterior surface area, which is axially immediately adjacent to the root fillet and has a fourth length $L_F$, is glazed with the glaze, a second sub-region of the third exterior surface area, which is axially distal from the root fillet and immediately adjacent to the first sub-region of the third exterior surface area, is unglazed and has a fifth length $L_G$; and $$L_F \geq L_G.$$

6. The ceramic spark plug insulator as recited in claim 5, wherein at least one of:

i) the second sub-region of the third exterior surface area extends to the tip of the insulator root and $L_G$ is ≥2 mm; and ii) $4\text{ mm} \leq L_F \leq (L_A+L_F+L_G)/2$.

7. The ceramic spark plug insulator as recited in claim 1, wherein:

the insulator head and the insulator root are connected to each another via an installation area that includes a collar at which the exterior diameter of the insulator is constantly at its greatest and that extends from a first axial collar end to a second axial collar end that is more proximal to the insulator root than the first axial collar end, the exterior diameter of the insulator decreasing from the first axial collar end in a direction away from the insulator root and decreasing from the second axial collar end in a direction towards the insulator root;

the collar is entirely formed of (a) a first sub-region of the collar that is of a second length $L_I$ and that is glazed with the glaze and (b) a second sub-region of the collar that is of a third length $L_J$, unglazed, and more distal from the insulator root than the first sub-region of the collar;

the second axial collar end is adjacent to a collar fillet that is glazed with the glaze and in which the exterior diameter of the insulator decreases; and $$0 < L_I \leq (L_J+L_I)/2.$$

8. The ceramic spark plug insulator as recited in claim 1, wherein, with respect to a total weight of the glaze, the glaze has the following composition:

$SiO_2$: 37.0 to 46.0 wt. %,
$B_2O_3$: 12.0 to 28.0 wt. %,
$Al2O_3$: 4.0 to 21.0 wt. %,
ZnO: 6.0 to 11.4 wt. %,
F: 0.6 to 4 wt. %,
$Li_2O$: 1.5 to 4 wt. %,
$Na_2O$: 0.1 to 2.5 wt. %,
$K_2O$: 0.5 to 4.5 wt. %,
CaO: 1.8 to 6 wt. %,
SrO: 0.1 to 3.6 wt. %, and
BaO: 0.8 to 6.8 wt. %.

9. The ceramic spark plug insulator as recited in claim 1, wherein, with respect to a total weight of the glaze, the glaze has the following composition:

$SiO_2$: 37.0 to 44.0 wt. %
$B_2O_3$: 17.5 to 23.0 wt. %
$Al2O_3$: 8.5 to 16.0 wt. %
ZnO: 7.8 to 11.4 wt. %
F: 0.6 to 3.0 wt. %
$Li_2O$: 1.9 to 3.5 wt. %
$Na_2O$: 0.1 to 2.0 wt. %
$K_2O$: 3.0 to 4.5 wt. %
CaO: 2.1 to 4.2 wt. %
SrO: 0.1 to 1.2 wt. % and
BaO: 4.5 to 6.5 wt. %.

10. The ceramic spark plug insulator as recited in claim 1, wherein the glaze has a layer thickness of 5 μm to 40 μm.

11. The ceramic spark plug insulator as recited in claim 1, wherein the glaze has a layer thickness of 7 μm to 25 μm.

12. The ceramic spark plug insulator as recited in claim 1, wherein, of the insulator, the root and only the root is arranged in a combustion chamber.

13. A spark plug for an internal combustion engine, comprising:

a metallic housing;

a center electrode;

at least one ground electrode, which is situated on the housing; and a ceramic spark plug insulator for separating the center electrode from the ground electrode, the ceramic spark plug insulator including:

an insulator head oriented in a direction of an electrical connection area;

a combustion chamber-side insulator root that includes a root fillet;

wherein:

with respect to a direction of axial extension of the spark plug, an exterior diameter of the insulator in a region of the root fillet gradually decreases between first and second axial ends of the root fillet, from a first diameter at the first axial end of the root fillet to a second diameter at the second axial end of the root fillet;

the exterior diameter remains constant at the second diameter within a first constant-diameter axial region of the insulator root that extends from the second axial end of the root fillet in a direction away from the insulator head towards a tip of the insulator root;

the exterior diameter remains constant at the first diameter within a second constant-diameter axial region of the insulator that extends from the first axial end of the root fillet in a direction away from the tip of the insulator root;

a first exterior surface area of the insulator, which axially spans an entirety of an axial span of the root fillet, is glazed with a glaze; and the axial span of the insulator root is of a first length $L_A$.

14. A method of using a glaze on a cross section reducing area of a spark plug insulator comprising:

providing a ceramic spark plug insulator including:

an insulator head oriented in a direction of an electrical connection area;

a combustion chamber-side insulator root that includes a root fillet; and glazing a first exterior surface area of the insulator with the glaze, thereby increasing a dielectric strength of the spark plug;

wherein:

with respect to a direction of axial extension of the spark plug, an exterior diameter of the insulator in a region of the root fillet gradually decreases between first and second axial ends of the root fillet, from a first diameter at the first axial end of the root fillet to a second diameter at the second axial end of the root fillet;

the exterior diameter remains constant at the second diameter within a first constant-diameter axial region of the insulator root that extends from the second axial end of the root fillet in a direction away from the insulator head towards a tip of the insulator root;

the exterior diameter remains constant at the first diameter within a second constant-diameter axial region of the insulator that extends from the first axial end of the root fillet in a direction away from the tip of the insulator root;

the first exterior surface area of the insulator axially spans an entirety of an axial span of the root fillet, which is of a first length $L_A$.

* * * * *